United States Patent [19]

Kobale et al.

[11] Patent Number: 4,663,564

[45] Date of Patent: May 5, 1987

[54] DEVICE FOR MAINTAINING CONSTANT PRESSURE IN GAS DISCHARGE VESSELS, PARTICULARLY FLAT PLASMA PICTURE SCREENS WITH ELECTRON POST-ACCELERATION

[75] Inventors: Manfred Kobale, Faistenhaar; Peter Mammach, Unterhaching, both of Fed. Rep. of Germany

[73] Assignee: Siemens Aktiengesellschaft, Berlin and Munich, Fed. Rep. of Germany

[21] Appl. No.: 735,575

[22] Filed: May 20, 1985

[30] Foreign Application Priority Data

Aug. 31, 1984 [DE] Fed. Rep. of Germany ..... 3432106

[51] Int. Cl.[4] ..... H01J 7/20; H01J 17/26

[52] U.S. Cl. ..... 313/551; 313/15

[58] Field of Search ..... 313/15, 44, 14, 37, 313/551, 582; 315/169.4; 340/713

[56] References Cited

U.S. PATENT DOCUMENTS

| | | | |
|---|---|---|---|
| 1,971,939 | 8/1934 | Pirani | 313/551 X |
| 3,956,667 | 6/1983 | Veith | 340/703 |
| 4,520,290 | 5/1985 | Cokefair | 313/15 |

*Primary Examiner*—David K. Moore
*Assistant Examiner*—K. Wieder

[57] ABSTRACT

An apparatus for maintaining constant pressure in gas discharge vessels, particularly for flat plasma picture screens with electron post-acceleration. The gas pressure is kept constant in the gas discharge vessel. For this purpose, a glass container preferably filled with helium is applied in the gas discharge vessel, this glass container being provided with a heater for temperature control and thus provides variable gas permeability. An apparatus of the invention is particularly employed for flat plasma picture screens.

7 Claims, 1 Drawing Figure

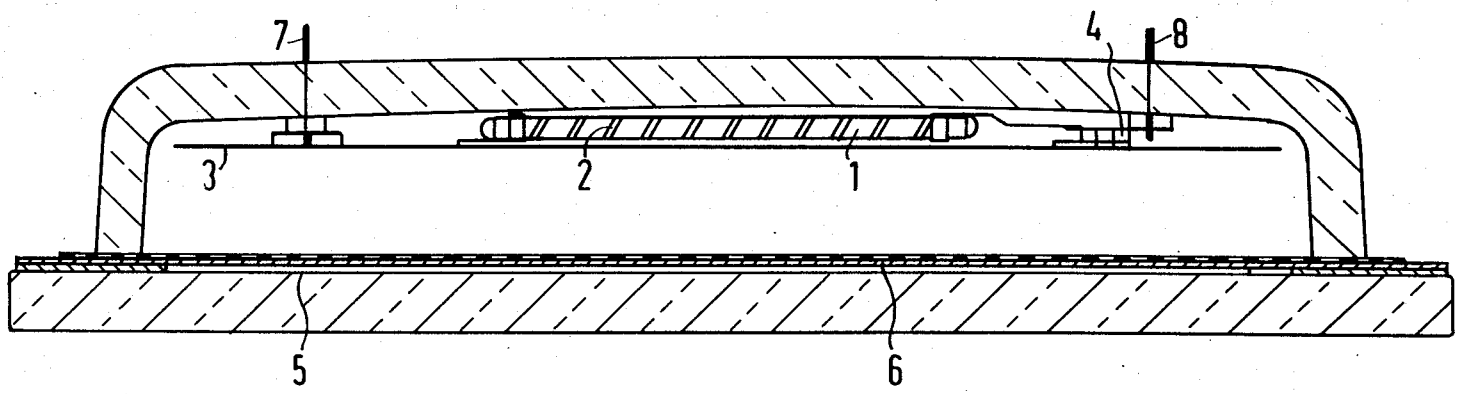
8
4
7
3'
2
1
6
5

DEVICE FOR MAINTAINING CONSTANT PRESSURE IN GAS DISCHARGE VESSELS, PARTICULARLY FLAT PLASMA PICTURE SCREENS WITH ELECTRON POST-ACCELERATION

BACKGROUND OF THE INVENTION

The invention relates to an apparatus for maintaining constant pressure in a gas discharge vessel, and particularly for a gas discharge vessel for flat plasma picture screens with electron post-acceleration.

Flat plasma picture screens with electron post-acceleration are generally known (see, for example, U.S. Pat. No. 3,956,667).

SUMMARY OF THE INVENTION

An object of the invention is to create an apparatus for a gas discharge vessel in which apparatus the gas pressure is kept constant.

This object is achieved in accordance with the invention by an apparatus for maintaining constant pressure which includes a glass container filled with helium in the gas discharge vessel, and wherein the glass container is provided with a heater means for temperature control so as to provide variable gas permeability.

With the invention, the pressure in a glass vessel in which a He plasma is preferably burning is held constant, whereby positive ions are accelerated in the post-acceleration space in the direction toward the cathode of the gas discharge vessel.

The gas reservoir established in the glass container comprises a gas permeability controllable with the temperature, and thus preferably variable for helium, so that a replenishment of helium is assured, dependent on the operating conditions.

BRIEF DESCRIPTION OF THE DRAWINGS

The drawing FIGURE shows in a cross-sectional side view a gas discharge vessel for flat plasma picture screens wherein a gas discharge vessel according to the invention is employed.

DESCRIPTION OF THE PREFERRED EMBODIMENTS

Helium is employed as a filling gas for the operation of a plasma picture screen with electron post-acceleration. The optimum filling pressure is 2.5 mbar. The gas volume, given a cell with a 12" diagonal, is about 1 $dm^3$.

In order to keep the diffusion through the glass wall as low as possible, a glass having low helium diffusion is employed for the cell envelope (for example, a soda-lime glass with about 15% alkalis). The helium diffusion through such a glass envelope is so slight that a pressure drop $<0.1$ mbar in ten years only need be considered. Glass containing lead oxide is employed as glass solder, this likewise having a low diffusion rate for helium.

When a gas discharge is ignited in such a cell, then He ions and electrons arise. In comparison to He atoms, He ions diffuse more intensively into surrounding surfaces so that a certain He consumption occurs. The main part of the helium is implanted into the cathode. Given a maintaining voltage of about 200 V, a current of 100 $\mu A/cm^2$, and a burning time of 10,000 h, about 0.5 mbar of helium are consumed. This gas consumption is still acceptable for the operation of a plasma picture screen cell.

The helium consumption rises significantly when the maintaining voltage is increased or when, as in the plasma picture screen, electron post-acceleration voltages of a number of kilovolts appear and He ions are also accelerated in the direction of the control plate and are implanted there. Up to 1 mbar helium per 1000 hours of operating time of the picture screen are consumed, depending on the type of plasma cathode, on the surface of the control plate facing the post-acceleration space, and on the level of the picture screen current.

A gas pressure below 2 mbar and above 3 mbar is not permitted for the faultless operation of the picture screen cell. Given too low a pressure, the picture contrast is reduced and the dielectric strength decreases given too high a pressure.

Based on the above observations, a gas replenishment is indispensable.

It is known that glasses having an extremely high $SiO_2$ and/or $B_2O_3$ constituent have rather considerable helium permeability. Thus, for example, the gas permeability of silica glass at 25° C. is greater by the factor $10^4$ than that of soda-lime glass. The premeation conductivity $q_{perm}$ of silica glass is $7.10^{-5}$ $mbar \times l/s \times mm/m^2 \times bar$.

Given a tube container (5 $cm^3$ content, 1 mm wall thickness) filled with 1 bar helium, this helium permeability would suffice without further effort, in order to compensate the implantation loss of helium in the lit cell.

When, however, the cell is only stored, i.e. hardly uses helium, then too much helium will be supplied from the reservoir vessel. Since a storage time of one year before initial operations can occur without further effort, the rise in pressure during this time may only amount to roughly 0.5 mbar. Given employment of silica glass, the pressure rise in one year would amount to about 5 mbar.

Glasses having a lower $SiO_2+B_2O_3$ content have lower He diffusion. In borosilicate glass free of alkaline earths, thus the $SiO_2+B_2O_3$ content is about 93%. The permeation conductivity for He at 25° C. is $$8 \cdot 10^{-6} (mbar\ l/s) \times (mm/m^2\ bar)$$

This value is so low that the pressure rise in the cell in a year can just still be tolerated. The replenishment for the lit mode is guaranteed when the donor tube is heated to 100° C. At this temperature, the permeability of borosilicate glass free of alkaline earths lies nearly two powers of ten higher than at room temperature. The heating power needed for the glass tube amounts to about 3 watts.

In the illustrative embodiment shown in schematic section in the drawing figure, those parts that do not contribute to an understanding of the invention have been omitted or left unreferenced.

The plasma screen cell shown in the drawing FIGURE is essentially composed of a picture screen 5 which is provided with a control plate 6. The plasma screen cell is closed by a glass cap in which the cathode 3 lying opposite the control plate 6 and provided with the power feed 7 is disposed. The glass container 1 is placed under this cathode 3. The glass container (glass ampule) is preferably provided with a helix of thick-film conductive paste serving as heater 2 and is heated by current passage via the power feed 8. The cathode holder 4 of insulating material is preferably composed of aluminum oxide ceramic.

Since, based on long-time test measurements, the He implantation in the cathode 3 decreases somewhat with increasing time, it suffices to make the volume of the glass container 1 just large enough so that about two gas charges ($2\times1$ $dm^3$, 2.5 mbar) can be supplied. This quantity corresponds to a He donor volume of $14\times4\times100$ $mm^3$ given a glass thickness of 1 mm as well as one bar filling pressure.

The He permeation rate is controlled via the He pressure of the plasma screen cell. The He pressure in turn is acquirable by measurement via the change in maintaining voltage.

Although various minor changes and modifications might be proposed by those skilled in the art, it will be understood that we wish to include within the claims of the patent warranted hereon all such changes and modifications as reasonably come within our contribution to the art.

We claim as our intention:

1. A system, comprising:

a gas discharge vessel formed by an envelope having a given gas therein;

a display screen in the vessel having a control means associated therewith;

a cathode formed in the glass envelope between a back portion thereof and the control means;

a completely enclosed glass container provided in the envelope;

the glass container containing a replenishment supply of said given gas for replenishing said given gas in the gas discharge vessel;

the glass container having a heater means associated therewith for selectively heating the replenishment gas so as to selectively increase its permeability through the glass container in order to replenish said given gas in the gas discharge vessel when the glass container is heated; and a glass material of the glass container being chosen for a predetermined permeability relative to the replenishment gas contained therein.

2. A system according to claim 1 wherein the glass container comprises a glass having at least one of the components selected from the group consisting of $SiO_2$ and $B_2O_3$.

3. A system according to claim 1 wherein the glass container comprises a borosilicate glass free of alkaline earths.

4. A system according to claim 1 wherein the glass container comprises a soda-lime glass.

5. A system according to claim 1 wherein the glass container comprises silica glass.

6. A system according to claim 1 wherein the glass container is surrounded by a heater in a form of a helix comprising thick-film conductive paste.

7. A flat plasma picture screen apparatus, comprising:

a picture screen having a control plate adjacent thereto so as to create a pulse-acceleration space therebetween;

a gas discharge vessel formed by providing an envelope in conjunction with the picture screen;

a cathode formed in the glass envelope between a back portion thereof and the control plate;

a glass container provided between the cathode and back portion of the envelope;

the glass container containing a replenishment gas for the gas in the gas discharge vessel;

the glass container having a heater means associated therewith for selectively heating the replenishment gas so as to selectively increase its permeability through the glass container in order to replenish gas in the gas discharge vessel when the glass container is heated; and a glass material of the glass container being chosen for a predetermined permeability relative to the replenishment gas contained therein.

* * * * *